US010865789B2

(12) United States Patent
Kaneko et al.

(10) Patent No.: US 10,865,789 B2
(45) Date of Patent: Dec. 15, 2020

(54) SCAVENGE PUMP WITH IMPROVED LUBRICATION

(71) Applicant: YAMADA MANUFACTURING CO., LTD., Kiryu (JP)

(72) Inventors: Atsushi Kaneko, Kiryu (JP); Kei Hosoya, Kiryu (JP)

(73) Assignee: YAMADA MANUFACTURING CO., LTD., Kiryu (JP)

( * ) Notice: Subject to any disclaimer, the term of this patent is extended or adjusted under 35 U.S.C. 154(b) by 196 days.

(21) Appl. No.: 16/142,838

(22) Filed: Sep. 26, 2018

(65) Prior Publication Data

US 2019/0120228 A1 Apr. 25, 2019

(30) Foreign Application Priority Data

Oct. 20, 2017 (JP) ..... 2017-203799

(51) Int. Cl.
*F04C 15/00* (2006.01)
*F04C 2/08* (2006.01)
*F04C 2/10* (2006.01)

(52) U.S. Cl.
CPC ..... *F04C 15/0088* (2013.01); *F04C 2/086* (2013.01); *F04C 2/102* (2013.01); *F04C 2240/60* (2013.01)

(58) Field of Classification Search
CPC ..... F04C 15/0088; F04C 2/086; F04C 2/102; F04C 2240/20; F04C 2240/56; F04C 2240/30
See application file for complete search history.

(56) References Cited

U.S. PATENT DOCUMENTS 6,152,717 A * 11/2000 Morita ..... F04C 2/102 418/107
8,075,284 B2 * 12/2011 Morita ..... F04C 15/0088 417/362
9,765,774 B2 * 9/2017 Terashima ..... F04C 2/086
2017/0184099 A1 * 6/2017 Watanabe ..... F04C 2/102

FOREIGN PATENT DOCUMENTS

JP S 63-131877 A 6/1988
JP H 09-317423 A 12/1997
JP 2010-168985 A 8/2010

* cited by examiner

*Primary Examiner* — Mary Davis
(74) *Attorney, Agent, or Firm* — McGinn IP Law Group, PLLC

(57) ABSTRACT

A scavenge pump includes: a pump housing including a housing body and a cover member, the housing body having a rotor chamber in which an inlet port, an outlet port, and a bearing hole formed by shaft holes with varying diameters with a stepped surface therebetween are provided; an outer rotor housed in the rotor chamber and having inner teeth; an inner rotor having outer teeth and a shaft support hole; and a drive shaft inserted or fixedly attached to the shaft support hole. The bearing hole includes a stepped inner circumferential part having a larger diameter than that of the drive shaft at an open peripheral edge on one side facing the rotor chamber, and a groove that extends through between a point close to a trailing end of the outlet port and the stepped inner circumferential part is formed.

5 Claims, 7 Drawing Sheets

ENLARGEMENT OF PART α

ROTOR ROTATION DIRECTION

ENLARGEMENT OF SECTION Y1-Y1 AS SEEN IN DIRECTION OF ARROWS

ENLARGEMENT OF SECTION X1-X1 AS SEEN IN DIRECTION OF ARROWS

ENLARGEMENT OF PART β

Fig.4A
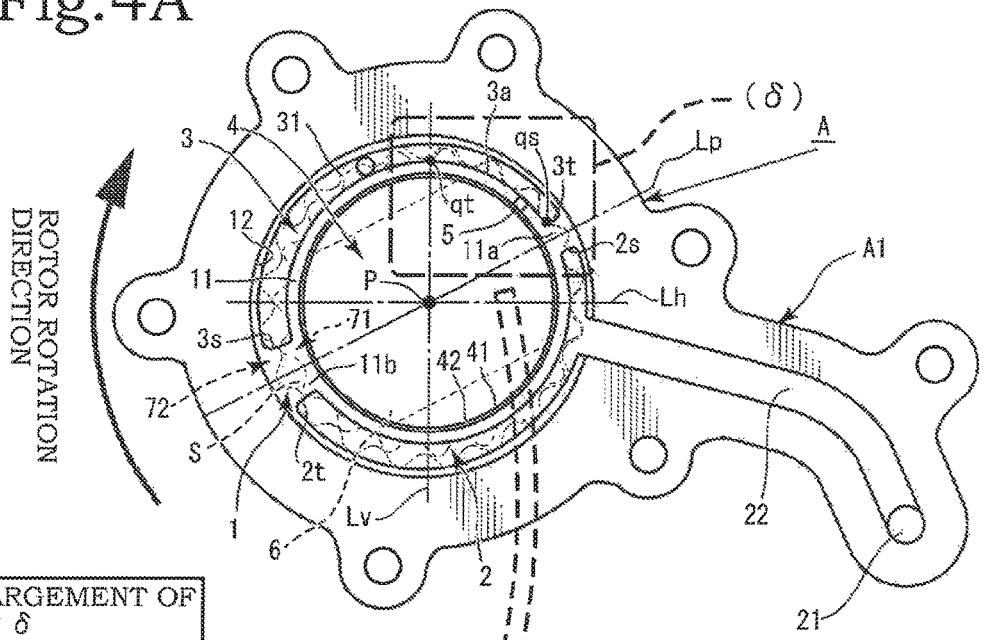
ENLARGEMENT OF PART δ
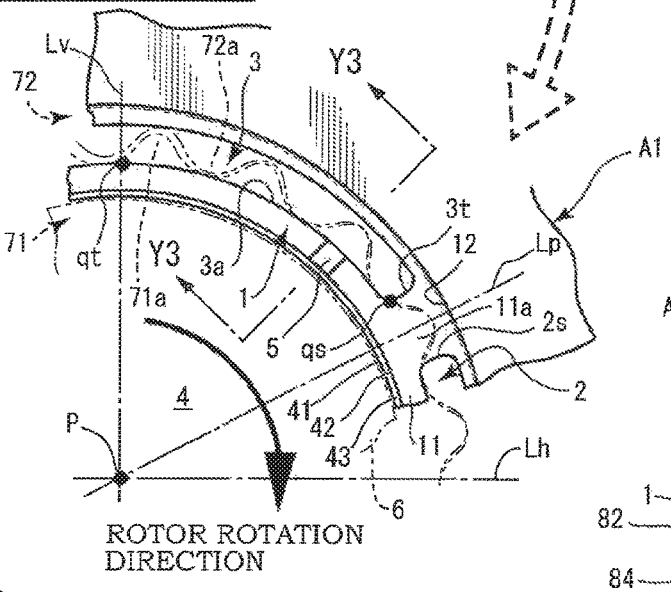
Fig.4B
Fig.4C
ENLARGEMENT OF SECTION Y3-Y3 AS SEEN IN DIRECTION OF ARROWS
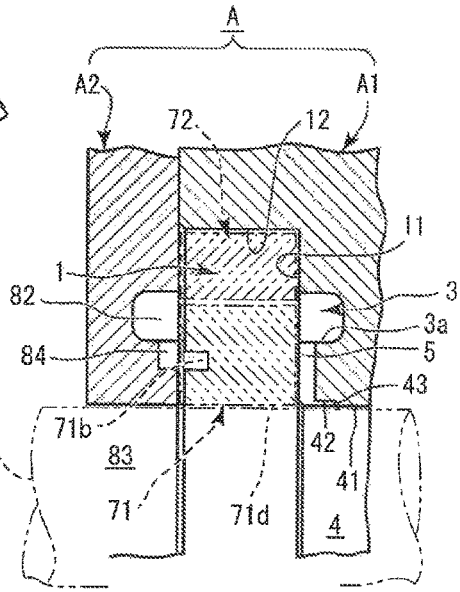

ENLARGEMENT OF SECTION Y4-Y4 AS SEEN IN DIRECTION OF ARROWS

ENLARGEMENT OF PART ε

SCAVENGE PUMP WITH IMPROVED LUBRICATION

BACKGROUND OF THE INVENTION

1. Field of the Invention

The present invention relates to a scavenge pump, which is a type of gear oil pump capable of achieving a favorable lubricated condition in a short time immediately after start-up, and which is capable of delivering oil quickly after start-up to a rotor chamber, a rotor, a drive shaft, and so on.

2. Description of the Related Art

Internal gear oil pumps are well known as oil pumps. Oil pumps for vehicles, such as feed pumps that draw oil from an oil pan and feed the oil to various parts of an engine, and scavenge pumps that return the oil after being fed to various parts of the engine and used for lubrication and the like back to the oil pan, have long been used in many vehicles and widely known. A scavenge pump is not necessarily installed in every vehicle. When the engine has a structure whereby the oil fed to various parts of the engine returns to the oil pan on its own, the scavenge pump is often not required.

For engines where the oil fed to various parts of the engine does not return to the oil pan on its own, the scavenge pump is required for forcibly returning the oil. There are many examples of scavenge pumps that use internal gears as with feed pumps. In a feed pump, a strainer is completely submerged in oil in the oil pan so that the substance the feed pump carries is mostly oil. On the other hand, a scavenge pump carries not only oil but also a lot of air because the oil that has lubricated various parts of the engine flows back intermittently.

Scavenge pumps and feed pumps have many similarities in their structures. The difference is that while feed pumps serve to feed oil from the oil pan to various parts of the engine, scavenge pumps provide the opposite function, i.e., to return the oil that has been fed to the engine back to the oil pan. Another difference is that, while feed pumps carry substantially oil alone, scavenge pumps carry not only oil but also air.

Japanese Patent Application Laid-open No. H09-317423 shows a feed pump (not a scavenge pump) having a structure of an oil pump. The oil pump shown in this publication is a common internal gear type, wherein a recess for keeping remaining oil is provided near an outlet port, closer to the center than the tooth bottom surface of the outer rotor such as to face the rotor chamber. The recess is provided on a side toward which the volume of the cell (i.e., interteeth space) is reduced (i.e., outlet side), and has a protrusion for stopping oil at the peripheral edge closer to the center than the tooth bottom surface of the outer rotor.

SUMMARY OF THE INVENTION

According to Japanese Patent Application Laid-open No. H09-317423, when the oil pump has not been operated for a long time with the engine being stopped for a long period, oil inside the oil pump drops out of the pump housing. Since hardly any oil remains inside, when the engine is re-started, the oil pump is not sufficiently capable of forming an oil film between the teeth of outer and inner rotors that form the rotor, or between an inner surface of a rotor chamber and side faces or an outer circumferential surface of the outer rotor, which would lead to problems such as progress of wear and increase of sliding resistance.

Japanese Patent Application Laid-open No. 2010-168985 offers a solution to the shortcoming of Japanese Patent Application Laid-open No. H09-317423. Japanese Patent Application Laid-open No. 2010-168985 shows a structure wherein, as the rotor rotates, oil can easily enter into a gap between a partition positioned between a trailing end of an outlet port and a leading end of an inlet port, and the rotor, so that an oil film is formed in the gap to achieve favorable lubrication of the rotor and rotor chamber. However, Japanese Patent Application Laid-open No. 2010-168985 does not describe lubrication of bearing halves (52).

The same effects are expected to be achieved by the structure shown in Japanese Patent Application Laid-open No. S63-131877. However, this publication does not show a structure that improves lubrication of a radial gap between a main body 1*a* and a main shaft 3. An object (technical solution) of the present invention is to prevent mixing of air at the start-up of the pump, and to deliver oil quickly to parts inside the pump to form oil films in parts contacting each other to enable smooth operation.

Through vigorous research, the inventors have achieved the above objects by providing a scavenge pump, which, according to a first aspect of the present invention, includes: a pump housing including a housing body and a cover member, the housing body having a rotor chamber in which an inlet port, an outlet port, and a bearing hole formed by shaft holes with varying diameters with a stepped surface therebetween are provided; an outer rotor housed in the rotor chamber and having inner teeth; an inner rotor having outer teeth and a shaft support hole; and a drive shaft inserted or fixedly attached to the shaft support hole of the inner rotor, wherein the bearing hole includes a stepped inner circumferential part having a larger diameter than that of the drive shaft at an open peripheral edge on one side facing the rotor chamber, and a groove that extends through between a point close to a trailing end of the outlet port and the stepped inner circumferential part is formed.

According to a second aspect of the present invention, in the scavenge pump according to the first aspect, the inner rotor includes a cylindrical shaft part that surrounds the shaft support hole, the cylindrical shaft part being fitted in or axially supported by the stepped inner circumferential part, whereby the above objects are achieved. According to a third aspect of the present invention, in the scavenge pump according to the first aspect, the drive shaft is inserted or axially supported in the bearing hole, whereby the above objects are achieved. According to a fourth aspect of the present invention, in the scavenge pump according to the second or third aspect, the stepped inner circumferential part is formed only on the housing body of the pump housing, whereby the above objects are achieved.

According to a fifth aspect of the present invention, in the scavenge pump according to the first or second aspect, the outlet port has a deepest point and a highest point of an inner circumferential surface thereof on one side closer to the bearing hole, the deepest point being positioned lower than the highest point, whereby the above objects are achieved.

According to a sixth aspect of the present invention, in the scavenge pump according to the first or second aspect, the groove is provided in plurality, whereby the above objects are achieved.

According to the present invention, there is formed a groove that extends through between a point close to the trailing end of the outlet port and the stepped inner circumferential part, so that oil is fed to between the stepped inner circumferential part and the bearing hole from the outlet port via the groove during the operation of the pump, whereby lubrication is achieved between the stepped inner circumferential part and the inner rotor, or between the bearing hole and the drive shaft. Also, an oil film is formed between the rotor chamber and the inner rotor and outer rotor to achieve smooth rotation of the rotor, as well as mixing of air from outside of the pump housing can be prevented.

BRIEF DESCRIPTION OF THE DRAWINGS

FIG. 4A is a front view of a housing body of a pump housing in a second embodiment of the present invention, FIG. 4B is an enlarged view of part δ of FIG. 4A, and FIG. 4C is an enlarged cross-sectional view taken in the direction of arrows Y3-Y3 of FIG. 4B;

DESCRIPTION OF THE PREFERRED EMBODIMENTS

Figure 1A:
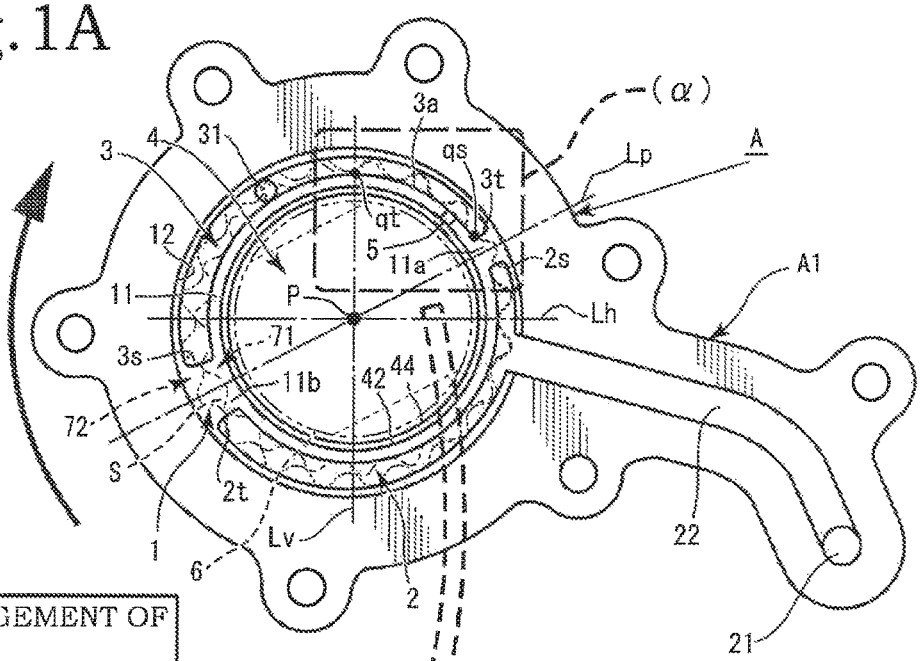
FIG. 1A is a front view of a housing body of a pump housing in a first embodiment of the present invention.

Hereinafter, embodiments of the present invention will be described with reference to the drawings. The present invention provides an internal gear pump generally composed of a pump housing A, an inner rotor 71, an outer rotor 72, and a drive shaft 6, as shown in FIGS. 1A to 1D. The pump housing A is made up of a housing body A1 and a cover member A2 (see FIGS. 2A and 2B). The housing body A1 is a main component of the pump housing A, where a rotor chamber 1 is formed. The rotor chamber 1 is a recessed cavity formed by a bottom part 11 and an inner circumferential wall 12.

Figure 2A:
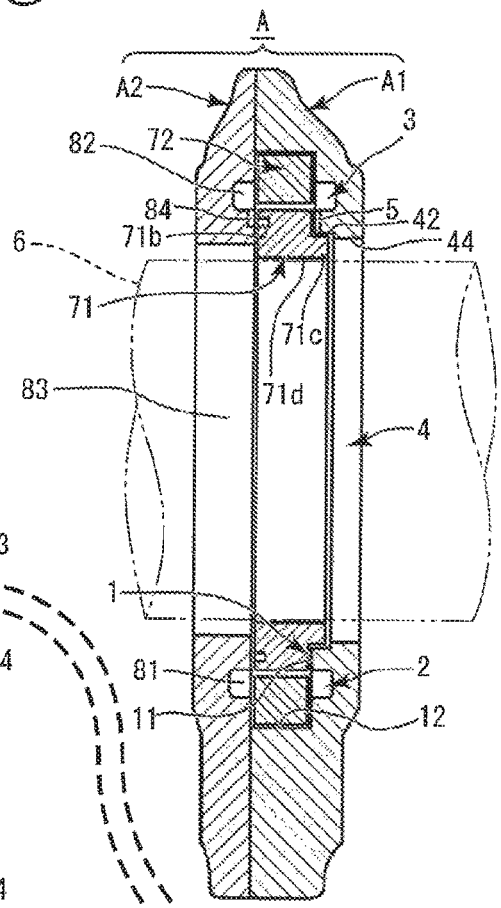
FIG. 2A is a longitudinal cross-sectional view of the pump housing, an inner rotor, and an outer rotor in the first embodiment of the present invention.
Figure 2B:
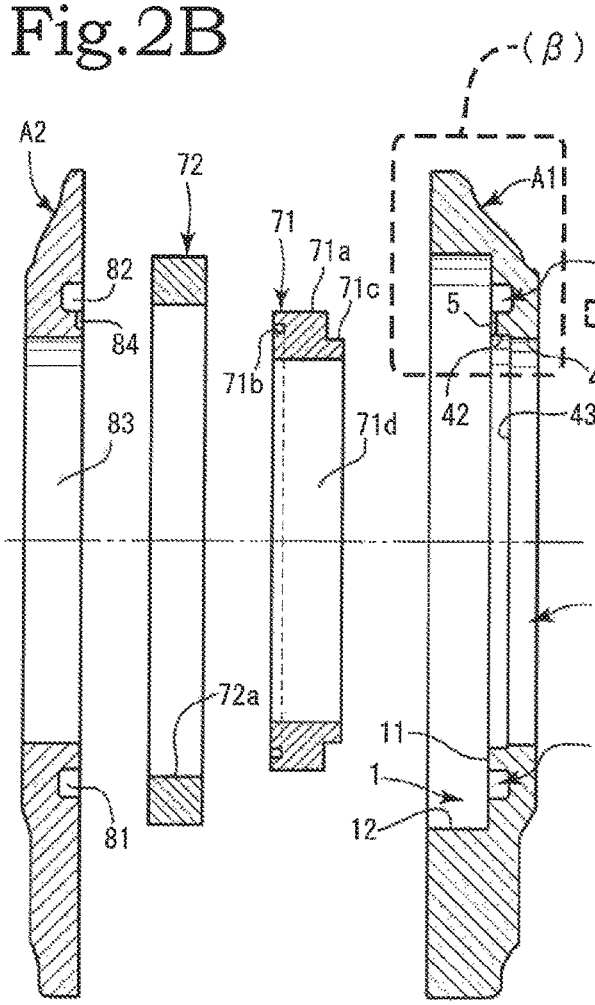
FIG. 2B is a longitudinal cross-sectional view showing the pump housing, inner rotor, and outer rotor in the first embodiment of the present invention separately.
Figure 2C:
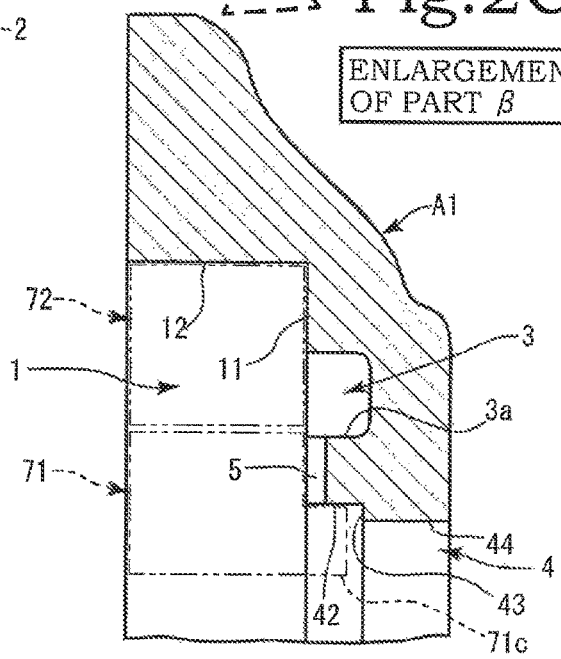
FIG. 2C is an enlarged view of part β of FIG. 2B.

An inlet port 2 and an outlet port 3 are formed in the bottom part 11 of the rotor chamber 1 (see FIG. 1A). The inlet port 2 includes an inlet hole 21 and an inlet guide passage 22. The outlet port 3 includes an outlet hole 31 inside. The outer rotor 72 and inner rotor 71 are housed inside the rotor chamber 1. A bearing hole 4 is provided in the bottom part 11 of the rotor chamber 1. The bearing hole 4 includes a plurality of coaxial shaft holes with varying diameters (such as a stepped inner circumferential part 42, a shaft through hole 44, and a drive shaft bearing hole 41) continuous via a stepped surface 43, and is commonly formed by two shaft holes, in particular. The bearing hole 4 comes in two forms: a first embodiment, in which the bearing hole receives a cylindrical shaft part 71*c* formed on the inner rotor 71 to be described later; and a second embodiment, in which the inner rotor 71 does not have the cylindrical shaft part 71*c*, and the bearing hole receives and axially supports the drive shaft 6.

In the first embodiment, the inner rotor 71 has a flat cylindrical shaft part 71*c* on one side, with the same diameter and center as the inner rotor. The cylindrical shaft part 71*c* may also sometimes be referred to as spigot. The cylindrical shaft part 71*c* serves as a rotary shaft for ensuring correct rotation of the inner rotor 71. In the first embodiment wherein the cylindrical shaft part 71*c* of the inner rotor 71 is inserted into the bearing hole 4 of the housing body A1, the bearing hole 4 is formed with a stepped inner circumferential part 42 for practically providing axial support for the cylindrical shaft part 71*c*. This stepped inner circumferential part 42 is a bearing hole for the cylindrical shaft part 71*c* of the inner rotor 71, and can also be referred to as an inner rotor bearing part 42. A shaft through hole 44 having an even smaller diameter is formed on one axial end of the stepped inner circumferential part (inner rotor bearing part) 42 via a stepped surface 43 orthogonal to the axial direction. The stepped surface 43 is an end face orthogonal to an axis line that runs along the axial direction of the drive shaft 6 mounted to the inner rotor 71.

The stepped inner circumferential part 42 forms a through hole that is part of the bearing hole 4, and is formed at the open peripheral edge on one side of the bearing hole 4 facing the rotor chamber 1. The stepped inner circumferential part 42 has a larger diameter than that of the drive shaft 6. More specifically, there is provided a gap of a predetermined distance between the inner circumference of the stepped inner circumferential part 42 and the outer circumference of the drive shaft 6. The diameter of the stepped inner circumferential part 42 is even larger than the diameter of the shaft through hole 44. Namely, the stepped inner circumferential part 42 is part of the bearing hole 4 with the largest diameter. The drive shaft 6 extends through the shaft through hole 44 but does not touch the inner circumferential surface of the shaft through hole 44. Namely, there is a gap between the inner circumference of the shaft through hole 44 and the outer circumference of the drive shaft 6. The stepped surface 43 is positioned in close proximity to but not in contact with an axial end of the cylindrical shaft part 71*c* of the inner rotor 71.

The diameter of the stepped inner circumferential part 42 should preferably be large enough to form a clearance (gap) c for oil to enter between itself and the cylindrical shaft part 71*c*. Namely, the stepped inner circumferential part 42 serves to form the clearance c. The bearing hole 4 may be provided with the stepped inner circumferential part 42 alone, without the shaft through hole 44 and stepped surface 43.

The inlet port 2 and outlet port 3 are groove-like recesses formed in a generally circular arc shape around the diametrical center of the bearing hole 4 as their diametrical center P. In this embodiment, the inlet port 2 and outlet port 3 are line symmetrical about a straight line radially passing through the diametrical center P. This line of symmetry shall be referred to as symmetry reference line Lp. Note, the inlet port 2 and outlet port 3 are only generally line symmetric about the symmetry reference line Lp and may somewhat differ in shape or size. More specifically, the inlet port 2 extends over a larger angle than that of the outlet port 3. In other words, the shapes of the inlet port 2 and outlet port 3 are determined based on the specifications of the pump.

For both of the inlet port 2 and outlet port 3, the ends on which the teeth (outer teeth 71*a* and inner teeth 72*a*) and cells S that are spaces between the teeth come in, in the rotating direction of the inner rotor 71 and outer rotor 72, shall be referred to as leading ends 2*s* and 3*s* of the inlet port 2 and outlet port 3, respectively, and the ends on which the teeth (outer teeth 71*a* and inner teeth 72*a*) and cells S move out shall be referred to as trailing ends 2*t* and 3*t* of the inlet port 2 and outlet port 3, respectively (see FIG. 1A). A region of the bottom part 11 between the leading end 2*s* of the inlet port 2 and the trailing end 3*t* of the outlet port 3 shall be referred to as a first seal land 11*a*, and a region of the bottom part 11 between the trailing end 2*t* of the inlet port 2 and the leading end 3*s* of the outlet port 3 shall be referred to as a second seal land 11*b*.

In the first seal land 11*a*, the inner rotor 71 and outer rotor 72 engage each other most deeply, and move on the first seal land 11*a* from the trailing end 3*t* of the outlet port 3 to the leading end 2*s* of the inlet port 2. In the second seal land 11*b*, a cell S having generally the largest space between outer teeth 71*a* of the inner rotor 71 and inner teeth 72*a* of the outer rotor 72 moves from the trailing end 2*t* of the inlet port 2 to the leading end 3*s* of the outlet port 3.

The inner rotor 71, and the outer rotor 72 having one more tooth than the inner rotor 71 are housed in the rotor chamber 1 of the pump housing A eccentrically so that their centers are offset. The plurality of outer teeth 71*a*, 71*a* . . . on the outer periphery of the inner rotor 71 mate with the plurality of inner teeth 72*a*, 72*a* . . . on the inner periphery of the outer rotor 72.

In the present invention, the rotating direction of the inner rotor 71 and outer rotor 72 is referred to as rotor rotation direction. This rotor rotation direction is clockwise when viewed from the open face of the housing body A1 around the diametrical center P of the bearing hole 4. Thus the cells S formed by the inner rotor 71 and outer rotor 72 rotate in the same direction as the rotor rotation direction, and move clockwise from the leading end 2*s* to the trailing end 2*t* of the inlet port 2, as well as from the leading end 3*s* to the trailing end 3*t* of the outlet port 3. This action continues during the operation of the pump (see FIGS. 1A and 1B).

During use, the scavenge pump of the present invention is oriented such that the axial line of the bearing hole 4 in the pump housing A is horizontal. Namely, when installed correctly, the bottom part 11 of the rotor chamber 1, and the inner rotor 71 and outer rotor 72 housed in the rotor chamber 1, have their radial direction oriented along a vertical plane (see FIG. 1C).

As noted above, the inlet port 2 and outlet port 3 are positioned and shaped such that they are line symmetrical (generally line symmetrical) about the symmetry reference line Lp passing through the diametrical center P of the bearing hole 4. The scavenge pump of the present invention is often configured such that, when installed correctly, the symmetry reference line Lp is inclined at less than 90° in the rotor rotation direction from a vertical line Lv passing through the diametrical center P of the bearing hole 4 (see FIG. 1A).

That is to say, the trailing end 3*t* of the outlet port 3 and the leading end 2*s* of the inlet port 2 are positioned at an angle of less than 90° from the vertical line Lv forward in the rotor rotation direction. More specifically, the trailing end 3*t* of the outlet port 3 and the leading end 2*s* of the inlet port 2 are positioned between the vertical line Lv and a horizontal line Lh passing through the diametrical center P. The symmetry reference line Lp may coincide with the horizontal line Lh so that the inlet port 2 and outlet port 3 are horizontally symmetrical.

Figure 1B:
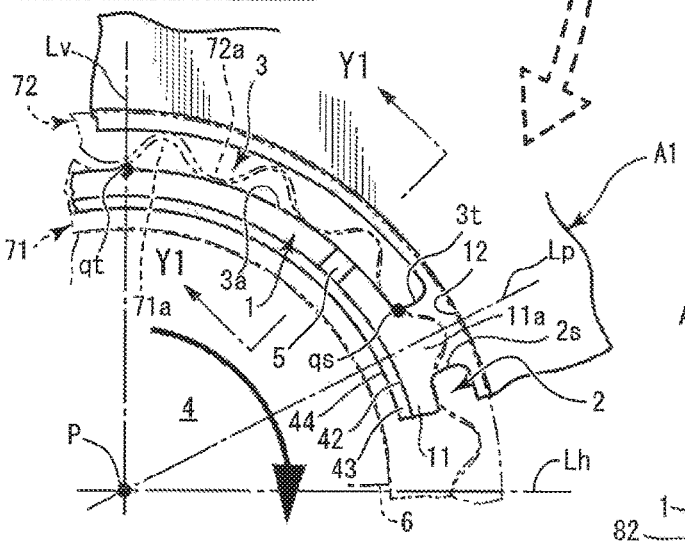
FIG. 1B is an enlarged view of part α of FIG. 1A.
Figure 1C:
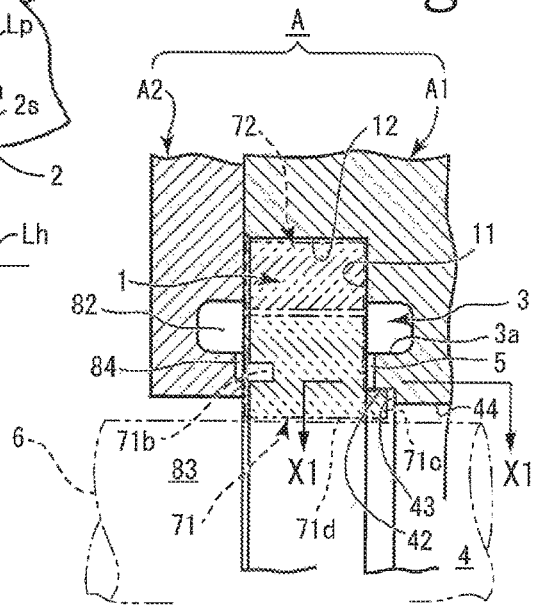
FIG. 1C is an enlarged cross-sectional view taken in the direction of arrows Y1-Y1 of FIG. 1B.
Figure 1D:
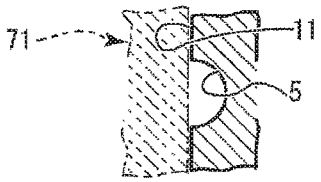
FIG. 1D is an enlarged cross-sectional view taken in the direction of arrows X1-X1 of FIG. 1C.

In the outlet port 3, the side face on the radially inner side of the groove width (radial) direction, in other words, the circumferential side face on the side closer to the bearing hole 4, shall be referred to as inner circumferential surface 3*a* (see FIGS. 1A, 1B, and 1C). The deepest (lowest) point qs of the trailing end 3*t* on the inner circumferential surface 3*a* of the outlet port 3 on the side closer to the bearing hole 4 is positioned lower than a highest point qt of the inner circumferential surface 3*a* (see FIGS. 1A and 1B). The deepest point qs here is not the entire outlet port 3 area, but rather, only the trailing end 3*t* and its vicinity of the outlet port 3. The highest point qt coincides with the vertical line Lv.

The port is formed such as to extend in a circular arc shape from the highest point qt to the deepest point qs of the inner circumferential surface 3*a* (see FIG. 1B). When the scavenge pump of the present invention is installed correctly at a predetermined point, the part between the highest point qt and the deepest point qs of the outlet port 3 serves as an oil sump and can always hold oil. However, when the symmetry reference line Lp is coincided with the vertical line Lv so that the inlet port 2 and outlet port 3 are vertically symmetrical, such an oil sump is not formed.

There is provided a groove 5 radially extending through between a point close to the trailing end 3*t* of the outlet port 3 and the bearing hole 4 (see FIGS. 1A to 1D to FIGS. 3A to 3D). More specifically, the groove 5 connects to the stepped inner circumferential part 42 of the bearing hole 4. The groove 5 is formed in the surface of the bottom part 11 of the rotor chamber 1. The groove 5 is shallower than the axial depth of the outlet port 3 in a portion where the groove 5 is formed (see FIG. 1C). More specifically, the depth of the groove 5 is about ⅓ to ½ of the depth of the outlet port 3, and is about 1 mm. The groove 5 has a generally semicircular cross-sectional shape (see FIG. 1D).

The groove 5 has the following functions. The groove 5 is formed at a point near the trailing end 3*t* of the outlet port 3 where the pressure in the cell S formed by the inner rotor 71 and outer rotor 72 reaches a peak level during the operation of the pump, so that the oil inside the cell S is pushed out around with high pressure (see FIG. 3A). In FIGS. 3A to 3D, the oil movement and pressure propagation are indicated by arrows.

Figure 3A:
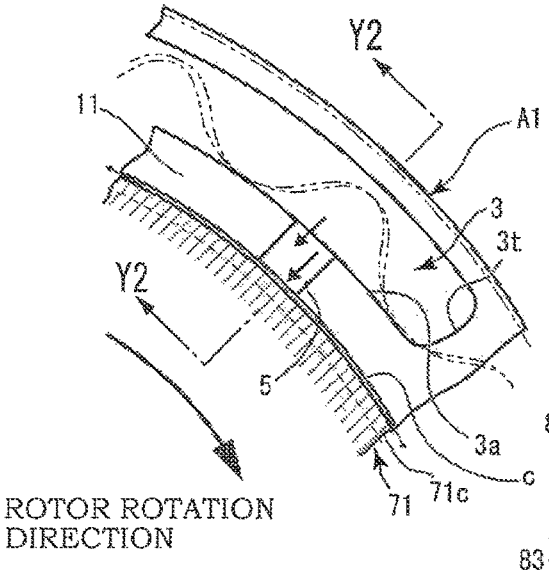
FIG. 3A is an enlarged view showing how oil is fed from a trailing end of an outlet port to a bearing hole by a groove in part α of FIG. 1A in the first embodiment of the present invention.

The oil pushed out of the cell S flows out into the outlet port 3, and part of the oil moves into the groove 5 (see FIG. 3A). The oil then flows through the groove 5 and eventually reaches the inner circumferential surface of the bearing hole 4. The cylindrical shaft part 71*c* of the inner rotor 71 is fitted in the stepped inner circumferential part 42 of the bearing hole 4. Since there is a clearance (gap) c of about several tens μm between the inner circumferential surface of the stepped inner circumferential part 42 and the outer circumferential surface of the cylindrical shaft part 71*c*, the oil is provided into the clearance c and serves as lubricating oil for allowing smooth rotation of the cylindrical shaft part 71*c*, as well as for preventing air mixing (see FIGS. 3A and 3B). The clearance c is about 20 μm to 50 μm.

Figure 3B:
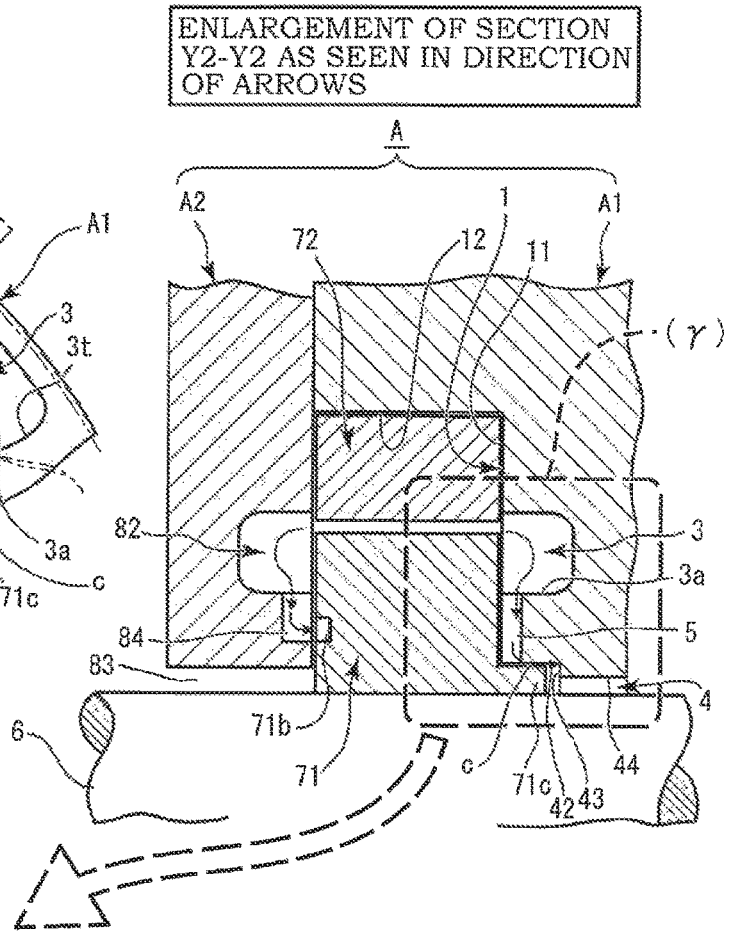
FIG. 3B is an enlarged cross-sectional view taken in the direction of arrows Y2-Y2 of FIG. 3A.
Figure 3C:
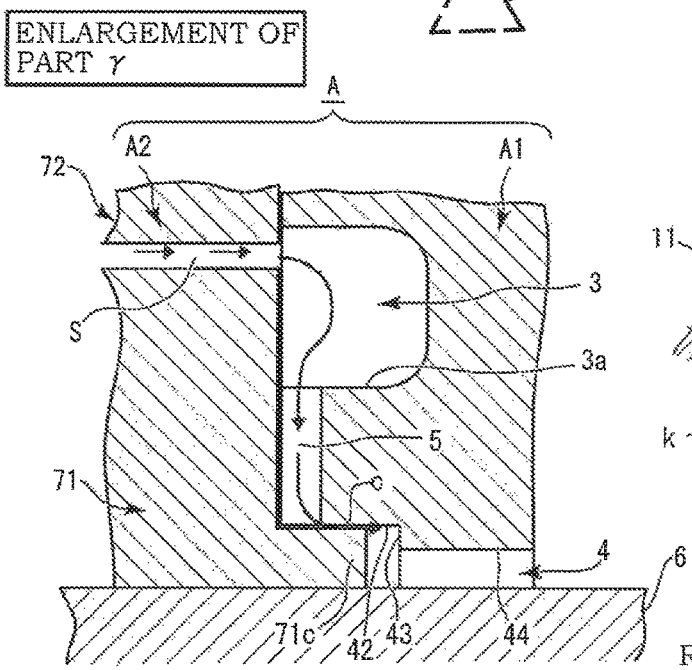
FIG. 3C is an enlarged view of part γ of FIG. 3B.
Figure 3D:
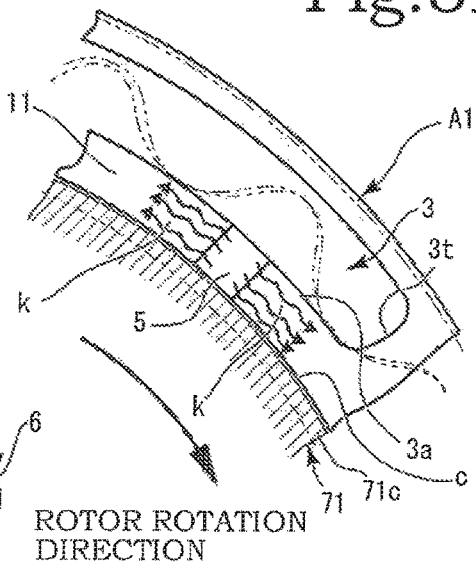
FIG. 3D is a diagram illustrating a process in which oil forms a film between a bottom part of a rotor chamber and a rotor side face because of the groove in part γ of FIG. 1A.

The opening of the groove 5 directly faces one of both axial side faces of the inner rotor 71 (see FIG. 1C and FIG. 3B). Therefore, as the inner rotor 71 is rotated by the drive shaft 6, the side face of the inner rotor 71 acts to force out some of the oil inside the groove 5, causing the oil to seep into between the side face of the inner rotor 71 and the bottom part 11 of the rotor chamber 1 (see FIG. 3C).

The seeping oil forms an oil film k between the bottom part 11 of the rotor chamber 1 and the side face of the inner rotor 71. This oil film k forms a seal between the bottom part 11 of the rotor chamber 1 and the side face of the inner rotor 71 so that air outside the pump housing A is prevented from entering the inlet port 2 through the bearing hole 4, for example, during the operation of the pump. Air entrance into the inlet port 2 is thus reduced, whereby suction performance can be further enhanced. The oil film also functions as lubricating oil for allowing smooth rotation of the inner rotor 71 and outer rotor 72, as well as prevents air mixing.

When the deepest point qs of the trailing end 3*t* of the outlet port 3 is positioned lower than the highest point qt of the inner circumferential surface 3*a*, there is formed an oil sump in the outlet port 3. Since oil is always kept in the oil sump, the groove 5 is always filled with oil, so that, as soon as the pump is activated the oil film k is created, and oil is supplied to provide lubrication between the inner circumferential surface and the cylindrical shaft part 71*c* of the inner rotor 71.

The groove 5 may be embodied in various forms. In the first embodiment, it is formed straight (see FIG. 1B, FIG. 3A and so on). In this embodiment, the trailing end 3*t* of the outlet port 3 and the bearing hole 4 can be connected with the shortest distance, so that the oil can be pumped out between the bearing hole 4 and the drive shaft 6 in the shortest time possible after the start-up of the scavenge pump.

Figure 7:
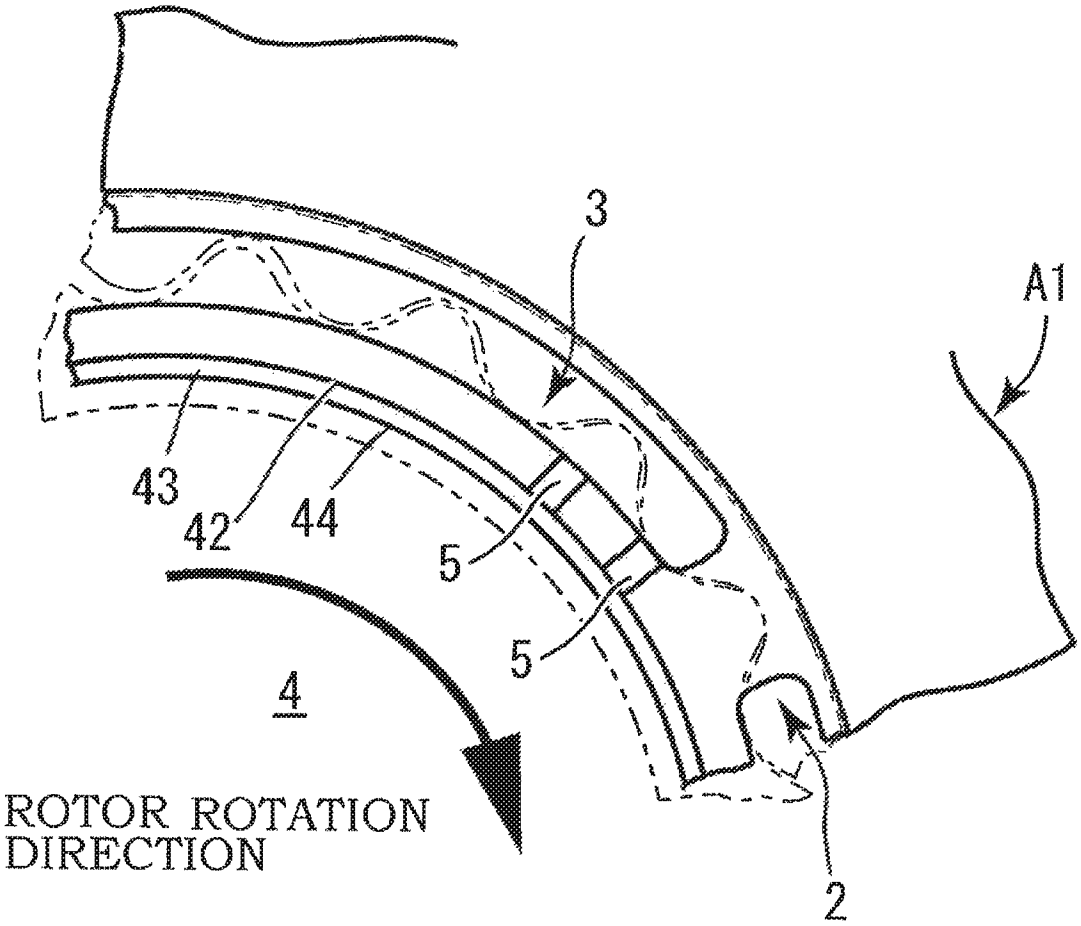
FIG. 7 is an enlarged view of essential parts in the housing body in an embodiment of the present invention wherein the groove is provided in plurality.

There is a second embodiment wherein the groove 5 is formed in plurality (see FIG. 7). The amount of oil fed to the bearing hole 4 is thereby increased so that more oil can be supplied to the clearance c between the inner circumferential surface of the bearing hole 4 and the outer circumferential surface of the drive shaft 6, whereby the favorable lubricated condition of the drive shaft 6 can be maintained, and air mixing can be prevented.

The inner rotor 71 has a tooth profile, specifically, shapes such as trochoidal, ellipsoidal, higher-order curve, and so on. A plurality of outer teeth 71*a*, 71*a* . . . are formed on the inner rotor 71, while a plurality of inner teeth 72*a*, 72*a* . . . are formed on the outer rotor 72. As the inner rotor 71 rotates, with the outer teeth 71*a* and inner teeth 72*a* mated with each other, the outer rotor 72 is rotated. In the second seal land 11*b*, the outer teeth 71*a* and inner teeth 72*a* form a closed space, i.e., cell (interteeth space) S to carry oil from the inlet port 2 to the outlet port 3.

The inner rotor 71 has a shaft support hole 71*d* in the diametrical center. The drive shaft 6 is mounted in this shaft support hole 71*d*. The cylindrical shaft part 71*c* surrounds the shaft support hole 71*d*. The cylindrical shaft part 71*c* having a substantially cylindrical ring shape is fitted into the stepped inner circumferential part 42 of the bearing hole 4, and axially supported such as to be rotatable. Oil is supplied to between the stepped inner circumferential part 42 and the cylindrical shaft part 71*c* via the groove 5 during the operation of the pump to provide lubrication for the rotation of the inner rotor 71 and to prevent air mixing.

The cover member A2 has a flat shape substantially the same as that of the housing body A1, and includes a cover-side inlet port 81, a cover-side outlet port 82, and a cover-side bearing hole 83 at positions corresponding to the inlet port 2, outlet port 3, and bearing hole 4 of the housing body A1, respectively. The cover-side inlet port 81 and cover-side outlet port 82 have the same shapes as the inlet port 2 and outlet port 3. Depending on the needs, there may be a cover-side groove 84 in the cover member A2 corresponding to the groove 5 of the housing body A1.

Figure 5A:
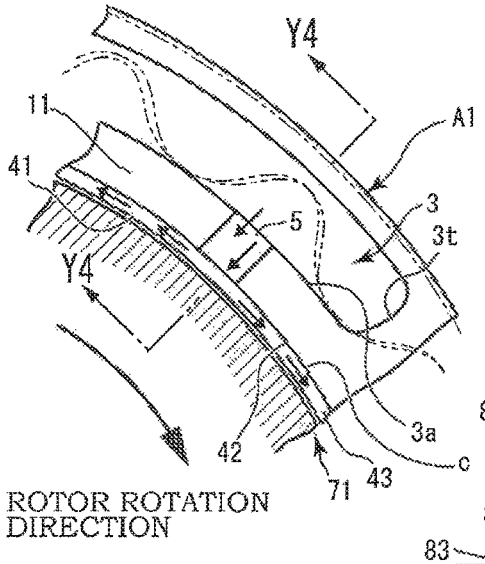
FIG. 5A is an enlarged view showing how oil is fed from the trailing end of the outlet port to the bearing hole by the groove in part δ of FIG. 4A in the second embodiment of the present invention.
Figure 5B:
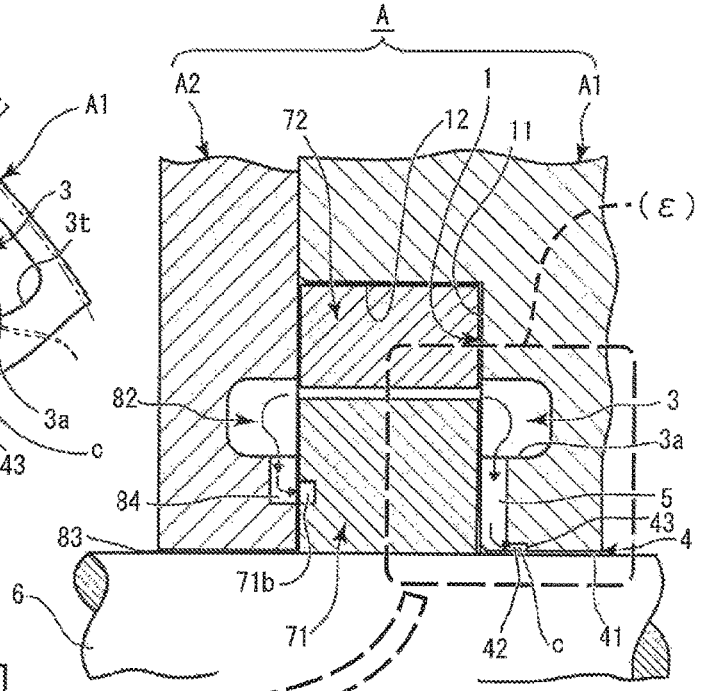
FIG. 5B is an enlarged cross-sectional view taken in the direction of arrows Y4-Y4 of FIG. 5A.
Figure 5C:
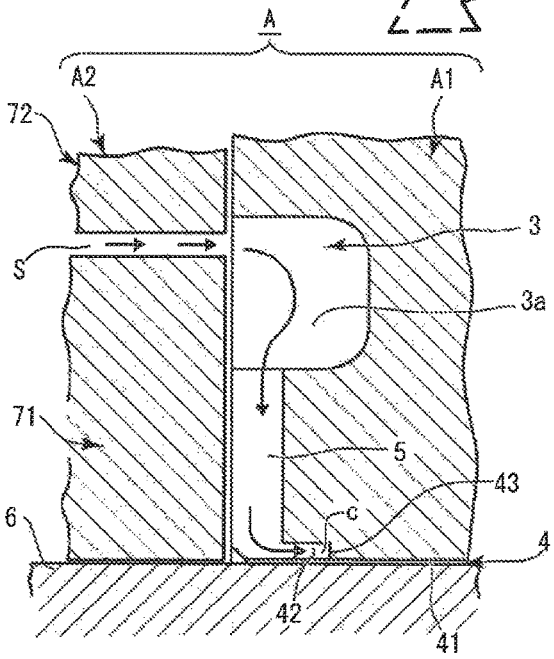
FIG. 5C is an enlarged view of part ε of FIG. 5B.
Figure 5D:
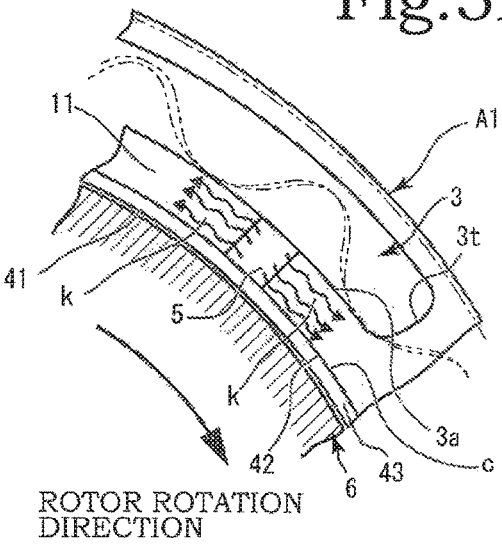
FIG. 5D is a diagram illustrating a process in which oil forms a film between the bottom part of the rotor chamber and the rotor side face because of the groove in part δ of FIG. 4A.
Figures 6A, 6B:
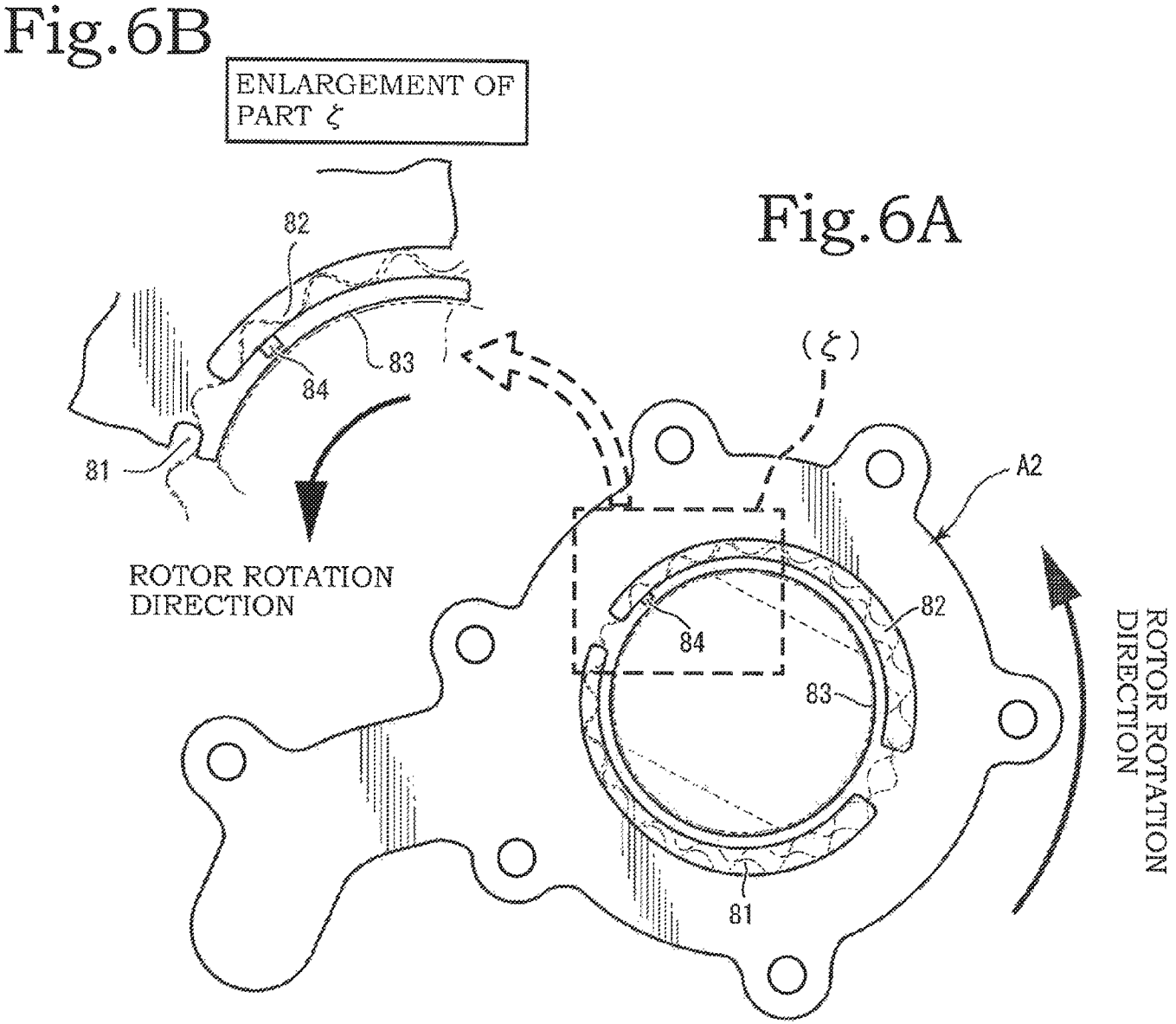
FIG. 6A is a plan view of a cover member in the present invention.
FIG. 6B is an enlarged view of part ζ of FIG. 6A.

The cover-side groove 84 of the cover member A2 is formed to communicate with a circumferential groove 71*b* provided in the side face of the inner rotor 71 as shown in FIG. 3B and FIG. 5B. By distributing oil in the circumferential groove 71*b*, air mixing to the inlet port 2 is reduced also on the cover member A2 side. Since the cover member A2 in this embodiment does not include a portion corresponding to the stepped inner circumferential part 42, the cover-side groove 84 does not reach or extend through to the cover-side bearing hole 83. If there is provided a portion corresponding to the stepped inner circumferential part 42 in the cover member A2, the cover-side groove 84 shall be extended through to reach the cover-side bearing hole 83.

The second embodiment of the present invention uses an inner rotor 71 that does not have the cylindrical shaft part 71*c*. The bearing hole 4 of the housing body A1 is formed by the stepped inner circumferential part 42 and the drive shaft bearing hole 41, with the stepped surface 43 therebetween. The stepped inner circumferential part 42 has a larger diameter than that of the drive shaft bearing hole 41 in this second embodiment, too. The drive shaft 6 mounted to the inner rotor 71 is axially supported in the drive shaft bearing hole 41 of the bearing hole 4. That is, the drive shaft bearing hole 41 is the bearing part of the drive shaft 6. In this second embodiment, the drive shaft 6 is axially supported in the drive shaft bearing hole 41 such as to be freely rotatable, and a clearance c is formed between the inner circumference of the stepped inner circumferential part 42 and the outer circumference of the drive shaft 6. Oil supplied from the groove 5 is fed to the clearance c between the stepped inner circumferential part 42 and the drive shaft 6 to provide lubrication and prevent air mixing to the inlet port 2 (see FIGS. 5A to 5D).

In the second embodiment, the cylindrical shaft part is formed around the shaft support hole of the inner rotor, and is fitted in or axially supported by the stepped inner circumferential part, so that the groove communicates with the stepped inner circumferential part and more oil can be held. Thus air mixing into the pump is prevented and pump efficiency can be maintained favorably. Also, similarly to the first embodiment, oil is supplied to between the stepped inner circumferential part on the pump housing side and the cylindrical shaft part on the inner rotor side so that a favorable lubricated condition is achieved.

In a third embodiment, the drive shaft of the scavenge pump is inserted in or axially supported by the bearing hole, so that a favorable lubricated condition is achieved between the bearing hole on the pump housing side and the drive shaft that drives the inner rotor. In a fourth embodiment, the stepped inner circumferential part is formed only on the housing body side of the pump housing. The structure of the cover body of the pump housing is thus simplified so that the number of production steps is reduced and costs can be reduced.

In a fifth embodiment, a deepest point of a trailing end on an inner circumferential surface of the outlet port on one side closer to the bearing hole is positioned lower than a highest point, so that the trailing end portion serves as an oil sump and lubrication is provided to the drive shaft instantaneously at the start-up of the pump, i.e., an oil film can be formed quickly. In a sixth embodiment, the groove is provided in plurality so that such an oil film can be formed even more quickly.

What is claimed is:

1. A scavenge pump, comprising:

a pump housing including a housing body and a cover member, the housing body having a rotor chamber in which an inlet port, an outlet port, and a bearing hole formed by shaft holes with varying diameters with a stepped surface therebetween are provided;

an outer rotor housed in the rotor chamber and having inner teeth;

an inner rotor having outer teeth and a shaft support hole; and a drive shaft inserted or fixedly attached to the shaft support hole of the inner rotor, wherein the bearing hole includes a stepped inner circumferential part having a larger diameter than that of the drive shaft at an open peripheral edge on one side facing the rotor chamber, and a groove that extends between a point close to a trailing end of the outlet port and the stepped inner circumferential part is formed, and wherein the inner rotor includes a cylindrical part that surrounds the shaft support hole, the cylindrical shaft part being fitted in or axially supported by the stepped inner circumferential part.

2. The scavenge pump according to claim 1, wherein the drive shaft is inserted or axially supported in the bearing hole.

3. The scavenge pump according to claim 1, wherein the stepped inner circumferential part is formed only on the housing body of the pump housing.

4. The scavenge pump according to claim 1, wherein the outlet port has a deepest point, which is positioned at the trailing end and on an inner circumferential surface on one side closer to the bearing hole, and a highest point on the inner circumferential surface, the deepest point being positioned lower than the highest point.

5. The scavenge pump according to claim 1, wherein the groove is provided in plurality.

* * * * *